US009931015B2

(12) United States Patent
Luciano et al.

(10) Patent No.: US 9,931,015 B2
(45) Date of Patent: Apr. 3, 2018

(54) HYDRAULICALLY-DRIVEN DISHWASHER DIVERTERS

(71) Applicant: Whirlpool Corporation, Benton Harbor, MI (US)

(72) Inventors: Juan I. Luciano, Saint Joseph, MI (US); Antony M. Rappette, Benton Harbor, MI (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 511 days.

(21) Appl. No.: 14/606,355

(22) Filed: Jan. 27, 2015

(65) Prior Publication Data

US 2016/0213219 A1 Jul. 28, 2016

(51) Int. Cl.
*A47L 15/22* (2006.01)
*A47L 15/42* (2006.01)

(52) U.S. Cl.
CPC ..... *A47L 15/22* (2013.01); *A47L 15/4221* (2013.01); *A47L 15/4225* (2013.01)

(58) Field of Classification Search
CPC ... A47L 15/22; A47L 15/4221; A47L 15/4225
USPC ..... 134/56 D, 57 D, 58 D, 178
See application file for complete search history.

(56) References Cited

U.S. PATENT DOCUMENTS

| | | | |
|---|---|---|---|
| 7,100,623 B2 | 9/2006 | Assmann et al. | |
| 7,594,513 B2 | 9/2009 | Vanderroest et al. | |
| 2004/0173249 A1* | 9/2004 | Assmann | A47L 15/4221 134/94.1 |
| 2006/0278258 A1 | 12/2006 | Kara et al. | |
| 2010/0071735 A1 | 3/2010 | Kang | |
| 2012/0060874 A1 | 3/2012 | Gnadinger et al. | |
| 2014/0299167 A1 | 10/2014 | Hong et al. | |

FOREIGN PATENT DOCUMENTS

| | | | |
|---|---|---|---|
| DE | 3406698 | A1 | 8/1985 |
| EP | 0057672 | A2 | 8/1982 |
| EP | 1101435 | B1 | 4/2009 |
| EP | 1767135 | B1 | 12/2010 |
| EP | 2786691 | A2 | 10/2014 |
| GB | 2023411 | A | 1/1980 |
| JP | 2007125154 | A | 5/2007 |
| WO | 03005875 | A1 | 1/2003 |
| WO | 2015102357 | A1 | 7/2015 |

OTHER PUBLICATIONS

European Search Report for Counterpart EP151941812, dated May 30, 2016.

* cited by examiner

*Primary Examiner* — Levon J Shahinian
(74) *Attorney, Agent, or Firm* — McGarry Bair PC

(57) ABSTRACT

Hydraulically-driven dishwasher diverters are disclosed herein. An example hydraulically-driven dishwasher diverter includes a diverter housing having a plurality of wash zone openings defined therethrough corresponding to respective wash zones of a dishwasher, and a rotating cylindrical diverter valve including a valve outlet to fluidly couple a fluid flowing through the cylindrical diverter valve through one of the wash zone openings, a flexible portion adjacent the valve outlet to seal another one of the wash zone openings in response to fluid pressure in the cylindrical diverter valve while the valve outlet is fluidly flowing the fluid through the one of the wash zone openings.

18 Claims, 10 Drawing Sheets

HYDRAULICALLY-DRIVEN DISHWASHER DIVERTERS

FIELD OF THE DISCLOSURE

This disclosure relates generally to dishwashers, and more particularly, to hydraulically-driven dishwasher diverters.

BACKGROUND

Dishwasher diverters direct fluid to different portions of the dishwasher at different times, usually in a cyclical manner, to wash items placed at different locations within the dishwasher during operation of the dishwasher. Conventional diverters are driven by a motor and a gear train.

SUMMARY

Hydraulically-driven dishwasher diverters are disclosed herein. An example hydraulically-driven dishwasher diverter includes a diverter housing having a plurality of wash zone openings defined therethrough corresponding to respective wash zones of a dishwasher, and a rotating cylindrical diverter valve including a valve outlet to fluidly couple a fluid flowing through the cylindrical diverter valve through one of the wash zone openings, a flexible portion adjacent the valve outlet to seal another one of the wash zone openings in response to fluid pressure in the cylindrical diverter valve while the valve outlet is fluidly flowing the fluid through the one of the wash zone openings

DETAILED DESCRIPTION

Figure 1:
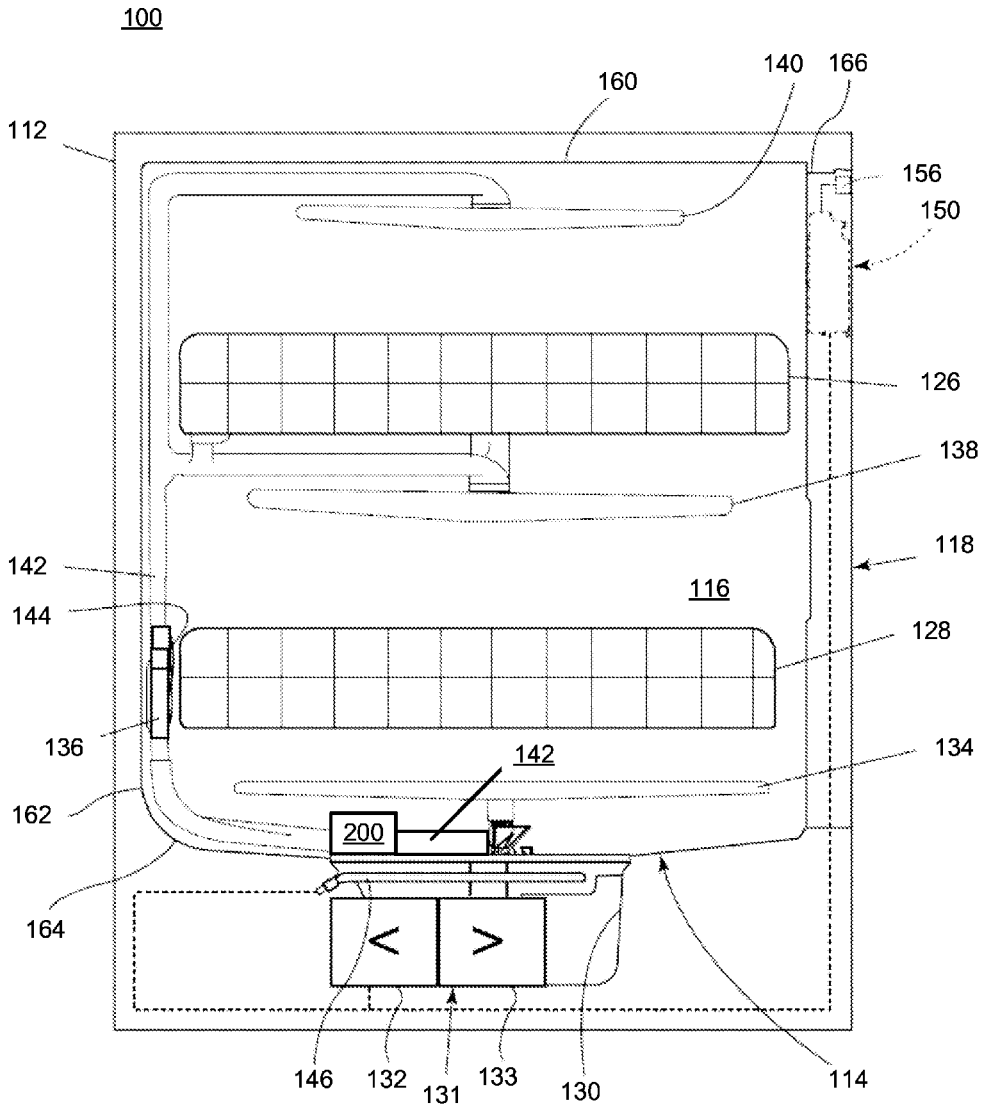
FIG. 1 is a schematic view of an example dishwasher having a hydraulically-driven diverter constructed in accordance with the teachings of this disclosure.

As is well known, many conventional dishwashers have a spray system having more than one spray zone or spray arm for spraying a fluid inside the treating chamber of a dishwasher during a cycle of operation. In some examples, a wash system includes a lower spray arm assembly, a mid-level spray arm assembly, and an upper spray arm assembly. The upper spray arm, the mid-level spray arm, and the lower spray are located, respectively, above an upper dish rack, beneath the upper dish rack, and beneath a lower dish rack. Another spray assembly may be located adjacent the lower dish rack toward the rear of a treating chamber, and includes a vertically oriented distribution header or spray manifold. Example spray manifolds are set forth in detail in U.S. Pat. No. 7,594,513 issued Sep. 29, 2009, and titled "Multiple Wash Zone Dishwasher," which is incorporated herein by reference in its entirety. A recirculation system recirculates fluid from a sump to the spray system. The sump collects the fluid sprayed in the treating chamber, and a pump draws the fluid from the sump and pumps it to the spray arms and/or spray assemblies for selective spraying. The recirculation system includes a diverter that sends the fluid to the sprays zones and/or spray arms at different times in, for example, a round-robin fashion.

Conventional dishwasher diverters are implemented as a part of a sump assembly. Some designs utilize a disk that rotates through four wash zone positions. The disk being rotated by a motor and gear train beneath the sump. Such designs require an extra motor and are not easily scaled to support more wash zones. To increase the number of wash zones requires a larger motor and disk. However, it is also desirable to also implement larger wash compartments, which constrains the size of the sump and the diverter motor.

To overcome at least these problems, hydraulically-driven diverters are disclosed herein. The example diverters disclosed herein have a cylindrical diverter valve split into longitudinal sections or segments. Each segment has a valve outlet. The valve outlets are spaced apart around the cylindrical diverter valve such that fluid flows or is diverted to only one wash zone at a time. Additionally or alternatively, the valve outlets may be spaced apart around the cylindrical diverter valve such that fluid flows to two or more wash zones at the same time. The example cylindrical diverter valves disclosed herein are flexible, and fluid pressure inside the cylindrical diverter valve forces the walls of the cylindrical diverter valve adjacent the valve outlets to flex outward against other wash zone openings, effectively sealing them. In disclosed examples, the cylindrical diverter valve is powered by a turbine in a flow stream that is turned by passing fluid flow. The turbine rotates a worm gear that turns the cylindrical diverter valve. The position of the cylindrical diverter valve is controlled by a solenoid that indexes a gear on an end of the cylindrical diverter valve, preventing it from moving when a position change is not desired.

As used herein, terms such as up, down, top, bottom, side, end, front, back, etc. are used with reference to the normal or currently considered orientation of an item, member, assembly, element, etc. If any of these is considered with respect to another orientation, it should be understood that such terms need to be correspondingly modified.

The particular implementations shown and described herein are illustrative examples and are not intended to otherwise limit the scope of this disclosure in any way. For the sake of brevity, conventional electronics, control systems, software development, and other functional aspects of the systems (and components of the individual operating components of the systems) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the embodiments unless the element is specifically described as "essential" or "critical".

In general, identical elements are illustrated with identical reference numerals in the figures; however, for brevity the description of identically numbered elements is not repeated. In some instances identical reference numerals are omitted when their inclusion could reduce clarity and/or comprehension.

Reference will now be made in detail to embodiments of this disclosure, examples of which are illustrated in the accompanying drawings. The embodiments are described below by referring to the drawings, wherein like reference numerals refer to like elements.

In FIG. 1, an automated dishwasher 100 according to a first embodiment is illustrated. The dishwasher 100 shares many well known features of a conventional automated dishwasher, which will not be described in detail herein except as necessary for a complete understanding of this disclosure. A chassis 112 defines an interior of the example dishwasher 100 and may include a frame, with or without panels mounted to the frame. An open-faced tub 114 is within the chassis 112 and may at least partially define a treating chamber 116, having an open face, for washing dishes. A door assembly 118 is movably mounted to the dishwasher 100 for movement between opened and closed positions to selectively open and close the open face of the tub 114. Thus, the door assembly provides accessibility to the treating chamber 116 for the loading and unloading of dishes or other washable items.

It should be appreciated that the door assembly 118 may be secured to the lower front edge of the chassis 112 or to the lower front edge of the tub 114 via a hinge assembly (not shown) configured to pivot the door assembly 118. When the door assembly 118 is closed, user access to the treating chamber 116 is prevented, whereas user access to the treating chamber 116 is permitted when the door assembly 118 is open.

Dish holders, illustrated in the form of upper and lower dish racks 126, 128, are located within the treating chamber 116 and receive dishes for washing. The upper and lower racks 126, 128 are typically mounted for slidable movement in and out of the treating chamber 116 for ease of loading and unloading. Other dish holders may be provided, such as a silverware basket. As used in this description, the term "dish(es)" is intended to be generic to any item, single or plural, that may be treated in the dishwasher 100, including, without limitation, dishes, plates, pots, bowls, pans, glassware, silverware, any other washable item.

A spray system is provided for spraying liquid in the treating chamber 116 and is provided in the form of a first lower spray assembly 134, a second lower spray assembly 136, a rotating mid-level spray arm assembly 138, and/or an upper spray arm assembly 140. Upper sprayer 140, mid-level rotatable sprayer 138 and lower rotatable sprayer 134 are located, respectively, above the upper rack 126, beneath the upper rack 126, and beneath the lower rack 124 and are illustrated as rotating spray arms. The second lower spray assembly 136 is illustrated as being located adjacent the lower dish rack 128 toward the rear of the treating chamber 116. The second lower spray assembly 136 is illustrated as including a vertically oriented distribution header or spray manifold 144. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 116 to the spray system. The example recirculation system includes a sump 130 and a pump assembly 131. The sump 130 collects the liquid sprayed in the treating chamber 116 and may be formed by a sloped or recess portion of a bottom wall of the tub 114. The pump assembly 131 may include both a drain pump 132 and a recirculation pump 133. The drain pump 132 may draw liquid from the sump 130 and pump the liquid out of the dishwasher 100 to a household drain line (not shown). The recirculation pump 133 may draw liquid from the sump 130 pump the liquid to a diverter 200 constructed in accordance with the teachings of this disclosure. The example diverter 200 is hydraulically operated responsive to water pumped to the diverter 200 by the recirculation pump 133. The diverter 200 simultaneously or selectively diverts the liquid through respective supply tubes 142 to the assemblies 134, 136, 138, 140 for selective spraying. In the example of FIG. 1, the diverter 200 is positioned at the rear of the sump 130 partially within the treating chamber 116. Of course, the diverter 200 may be positioned elsewhere. Examples manners of implementing the diverter 200 are described below in connection with FIGS. 3-17C. While not shown, a liquid supply system may include a water supply conduit coupled with a household water supply for supplying water to the treating chamber 116.

A heating system including a heater 146 may be located within the sump 130 for heating the liquid contained in the sump 130.

A controller 150 may also be included in the dishwasher 100, which may be operably coupled with various components of the dishwasher 100 to implement a cycle of operation. The controller 150 may be located within the door 118 as illustrated, or it may alternatively be located somewhere within the chassis 112. The controller 150 may also be operably coupled with a control panel or user interface 156 for receiving user-selected inputs and communicating information to the user. The user interface 156 may include operational controls such as dials, lights, switches, and displays enabling a user to input commands, such as a cycle of operation, to the controller 150 and receive information.

Figure 2:
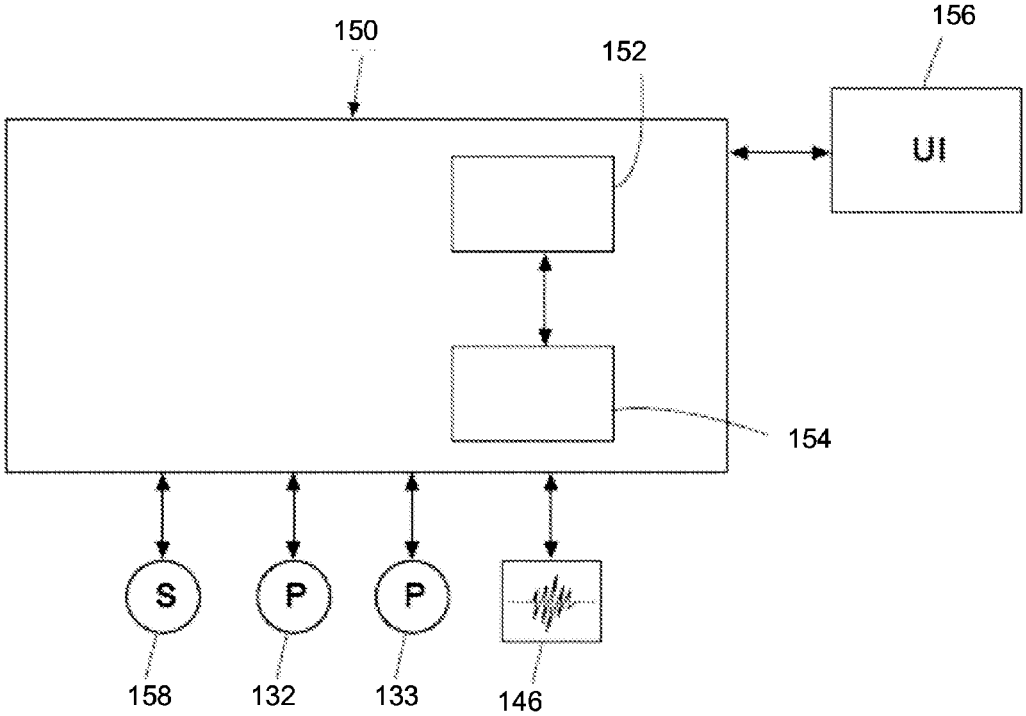
FIG. 2 is a schematic of an example control system for the example dishwasher of FIG. 1.
Figure 3:
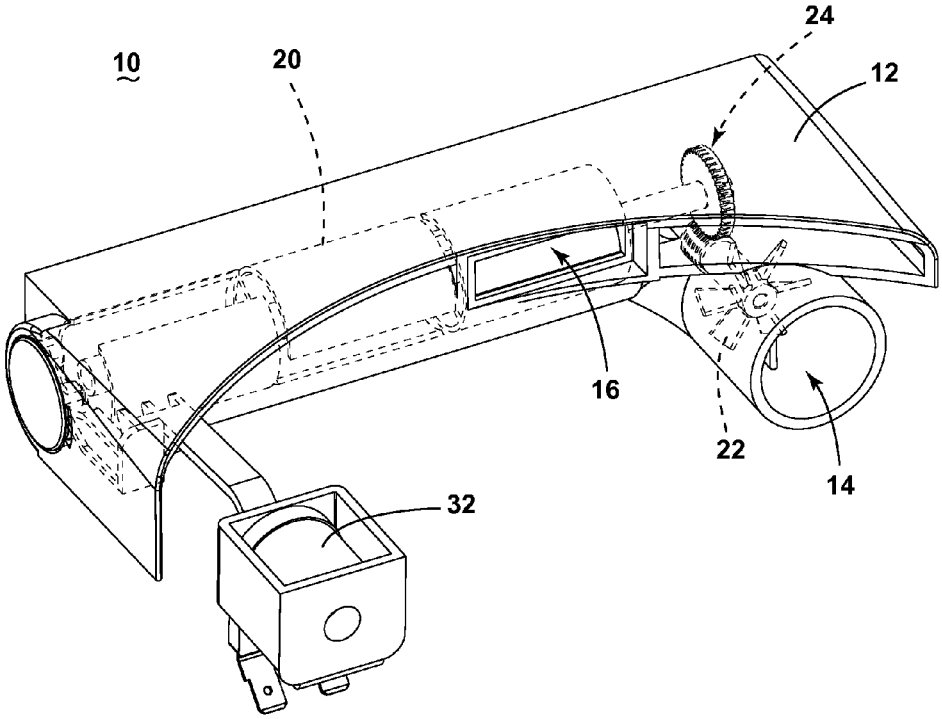
FIGS. 3 and 4 are isometric perspective views of an example hydraulically-driven dishwasher diverter constructed in accordance with the teachings of this disclosure.
Figure 4:
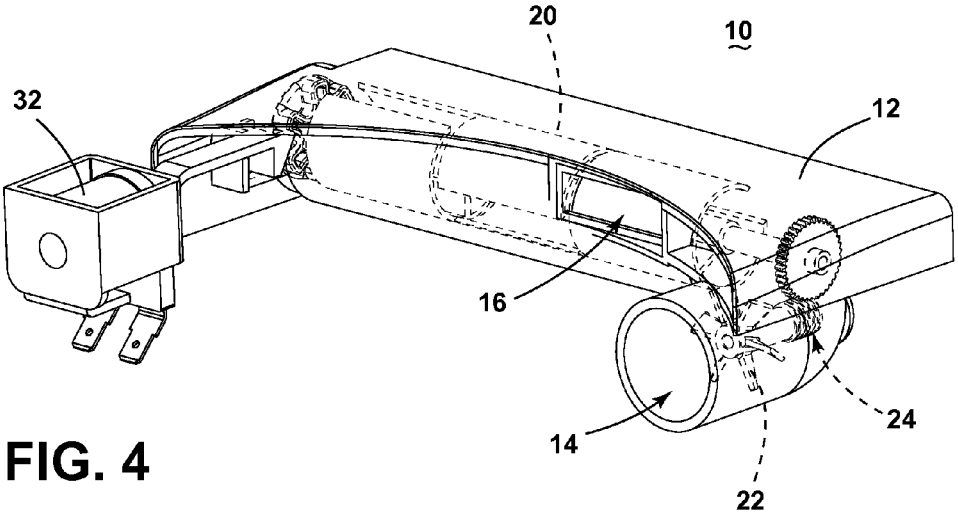

As illustrated schematically in FIG. 2, the controller 150 may be coupled with the heater 146 for heating the wash liquid during a cycle of operation, the drain pump 132 for draining liquid from the treating chamber 116, and the recirculation pump 133 for recirculating the wash liquid during the cycle of operation. The controller 150 may be provided with a memory 152 and a central processing unit (CPU) or processor 154. The processor 154 can be implemented by, for example, one or more Atmel®, Intel®, AMD®, and/or ARM® microprocessors. Of course, other processors from other processor families and/or manufacturers are also appropriate.

The memory 152 may be used for storing control software that may be executed by the CPU 154 in completing a cycle of operation using the dishwasher 100 and any additional software. For example, the memory 152 may store one or more pre-programmed cycles of operation that may be selected by a user and completed by the dishwasher 100. The memory 152 may include volatile memory such as synchronous dynamic random access memory (SDRAM), a dynamic random access memory (DRAM), RAMBUS® dynamic random access memory (RDRAM) and/or any other type of random access memory (RAM) device(s); and/or non-volatile memory such as flash memory(-ies), or flash memory device(s).

The controller 150 may also receive input from one or more sensors 158. Non-limiting examples of sensors that may be communicably coupled with the controller 150 include a temperature sensor and turbidity sensor to determine the soil load associated with a selected grouping of dishes, such as the dishes associated with a particular area of the treating chamber.

FIGS. 3-7 are views of an example hydraulically-driven dishwasher diverter 10 constructed in accordance with the teachings of this disclosure that may be used to implement the example diverter 200 of FIG. 1. As shown, the diverter 10 includes a housing 12 having a conduit or inlet 14. The housing 12 has openings, three of which are designated at reference numerals 16, 17 and 18, corresponding to respective wash and/or spray zones and/or arms. FIGS. 8-14 are views of the internal components of FIGS. 3-7, with the housing 12 removed.

Fluid flows in through the inlet 14 and then flows into a cylindrical diverter valve 20. The fluid may be directed into the inlet 14 by, for example, a recirculation pump (not shown). A turbine 22 is positioned in the fluid flow, and rotates in response to the fluid flow. Rotation of the turbine 22 operates a worm gear assembly 24, such that rotation of the turbine 22 causes the cylindrical diverter valve 20 to rotate. In the illustrated examples, the inlet 14 is perpendicular to the cylindrical diverter valve 20. The worm gear assembly 24 accommodates the right angle positioning of the inlet 14 and cylindrical diverter valve 20, and gears down the rotational rate of the cylindrical diverter valve 20 relative to the spin rate of the turbine 22.

Figure 11:
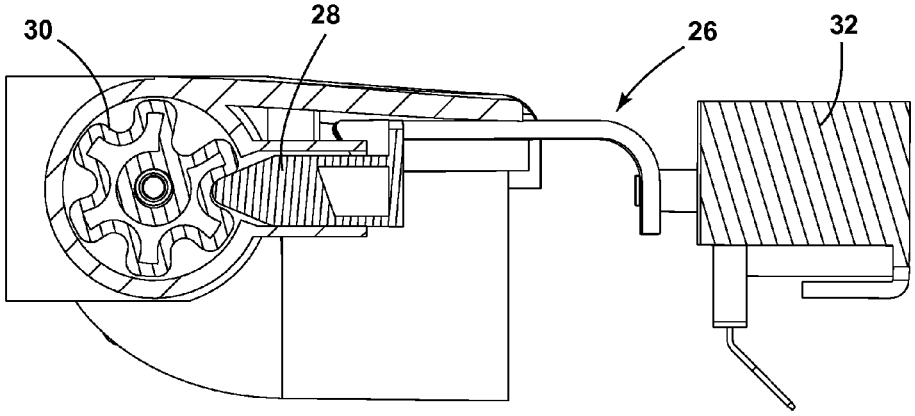
FIG. 11 is an end cross-section view of the example internal component of FIGS. 8-10 taken along line XI-XI of FIG. 8.
Figure 12:
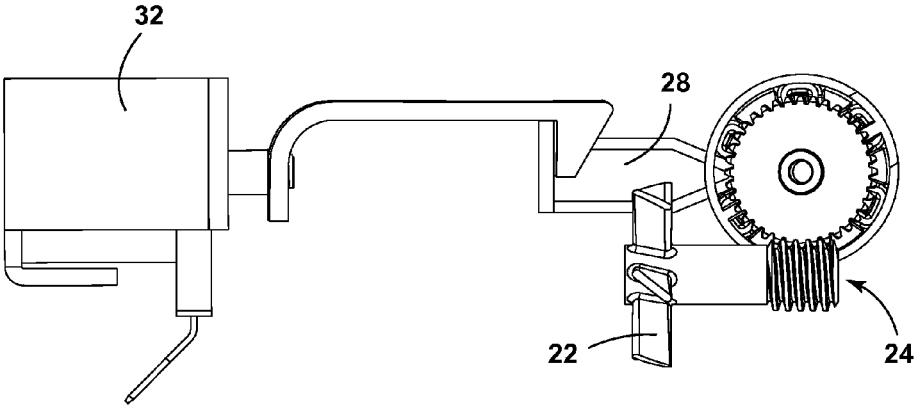
FIGS. 12-14 are respectively end, front and rear views of the example internal components of FIGS. 8-10.
Figure 13:
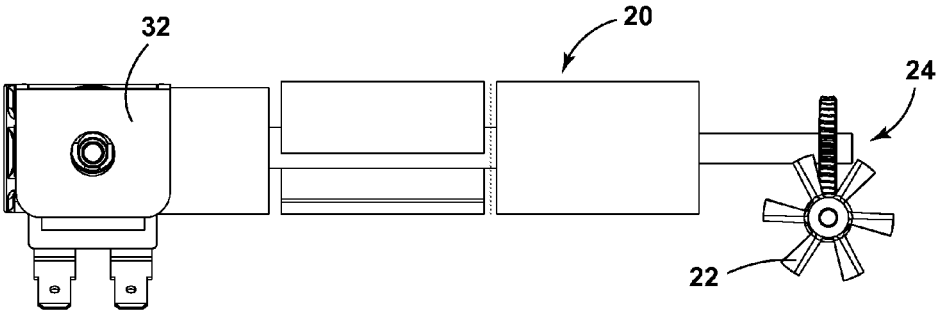
Figure 14:
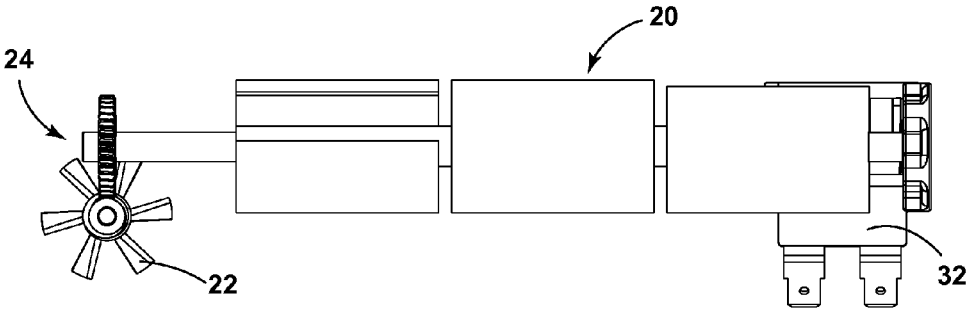

As clearly shown in at least FIG. 11, a motor assembly 26 at an end of the cylindrical diverter valve 20 controls rotation of the cylindrical diverter valve 20 in a step-wise fashion. A moveable member, arm or finger 28 engages teeth 30 to hold the cylindrical diverter valve 20 at a finite set of positions. In some examples, the finger 28 is moved right and left, in the orientation of FIG. 11, out of and into engagement with the teeth 30. The finger 28 reciprocates responsive to a motor 32. In some examples, the motor 32 is a solenoid that reciprocates the finger 28. Other example motor assemblies 26 include a stepper motor. In the example shown, the motor assembly 26 is at the left end (in the orientations of FIGS. 3-5) of the cylindrical diverter valve 20. However, it will be appreciated that it may be located elsewhere along the length of the cylindrical diverter valve 20.

Figure 15A:
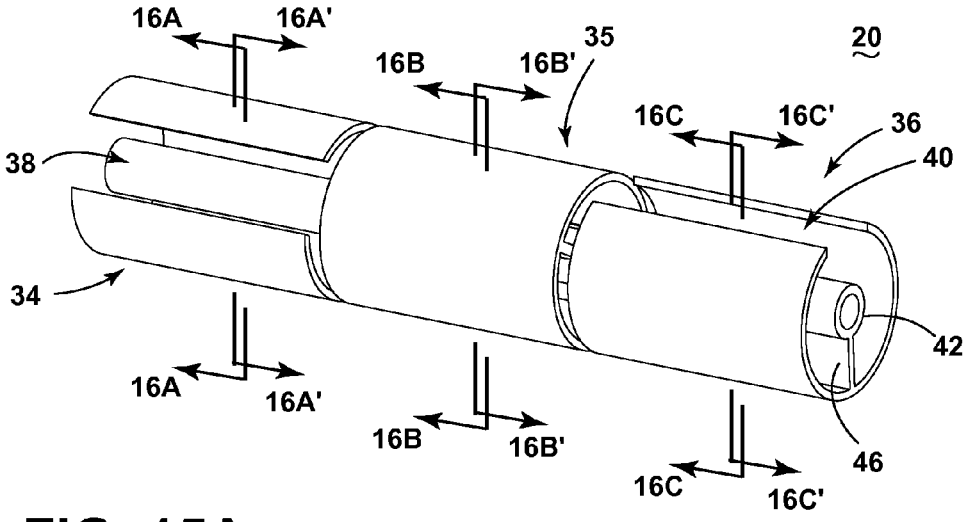
FIGS. 15A-15B are isometric perspective views of the example cylindrical diverter valve of FIGS. 3-14 at respective different rotational positions of the cylindrical diverter valve.
Figure 15B:
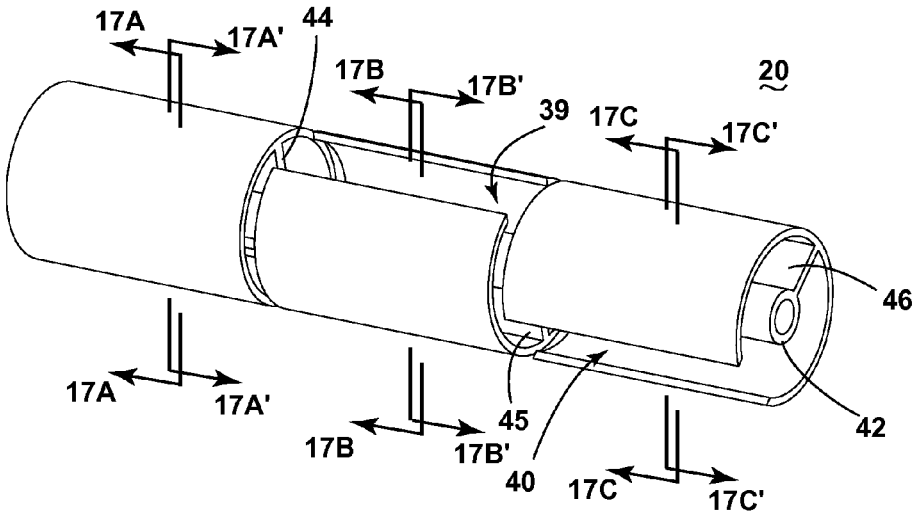

FIGS. 15A-15B are isometric perspective views of the example cylindrical diverter valve 20 of FIGS. 3-14 at two different rotational positions of the cylindrical diverter valve 20. The example cylindrical diverter valve 20 has three longitudinal segments 34, 35 and 36. Each of the example segments 34-36 has a respective valve outlet 38-40. As shown, the valve outlets 38-40 are spaced apart around the circumference of the cylindrical diverter valve 20. As the cylindrical diverter valve 20 is rotated different ones of the valve outlets 38-40 will align with the wash zone openings 16-18.

Figure 16A:
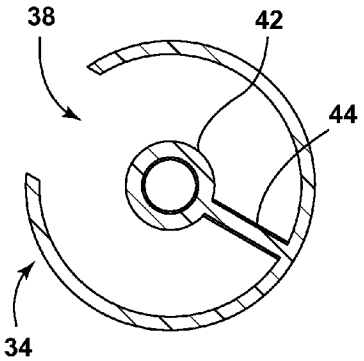
FIG. 16A is an end view of a slice defined by line 16A-16A and line 16A'-16A' of FIG. 15A.
Figure 16B:
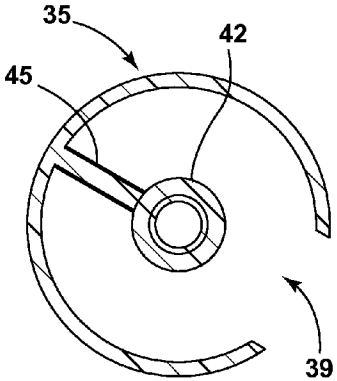
FIG. 16B is an end view of a slice defined by line 16B-16B and line 16B'-16B' of FIG. 15A.
Figure 16C:
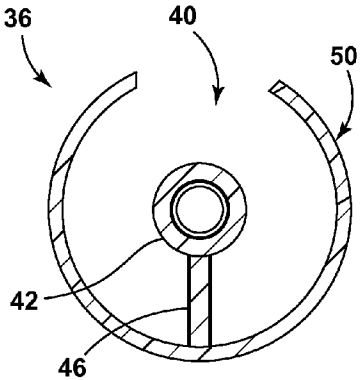
FIG. 16C is an end view of a slice defined by line 16C-16C and line 16C'-16C' of FIG. 15A.

Consider a first rational position of the cylindrical diverter valve 20 shown in FIG. 15A. FIG. 16A is an end view of a slice defined by line 16A-16A and line 16A'-16A' of FIG. 15A. FIG. 14B is an end view of a slice defined by line 14B-14B and line 14B'-14B' of FIG. 15A. FIG. 16C is an end view of a slice defined by line 16C-16C and line 16C'-16C' of FIG. 15A.

Figure 17A:
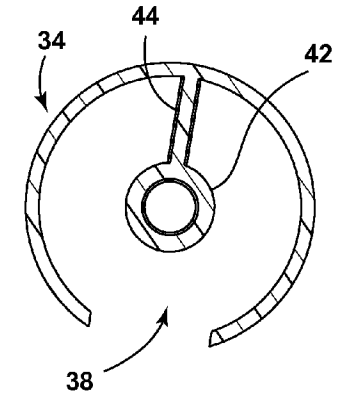
FIG. 17A is an end view of a slice defined by line 17A-17A and line 17A'-17A' of FIG. 15B.
Figure 17B:
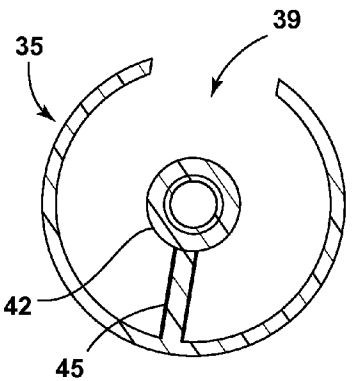
FIG. 17B is an end view of a slice defined by line 17B-17B and line 17B'-17B' of FIG. 15B.
Figure 17C:
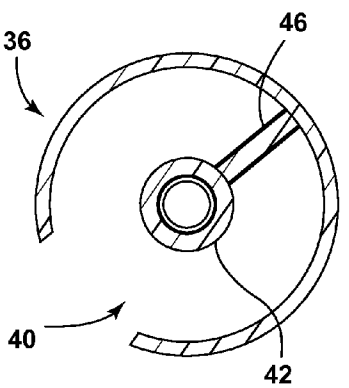
FIG. 17C is an end view of a slice defined by line 17C-17C and line 17C'-17C' of FIG. 15B.

Consider another rational position of the cylindrical diverter valve 20 shown in FIG. 15B. FIG. 17A is an end view of a slice defined by line 17A-17A and line 17A'-17A' of FIG. 15B. FIG. 17B is an end view of a slice defined by line 17B-17B and line 17B'-17B' of FIG. 15B. FIG. 17C is an end view of a slice defined by line 17C-17C and line 17C'-17C' of FIG. 15B.

Figure 5:
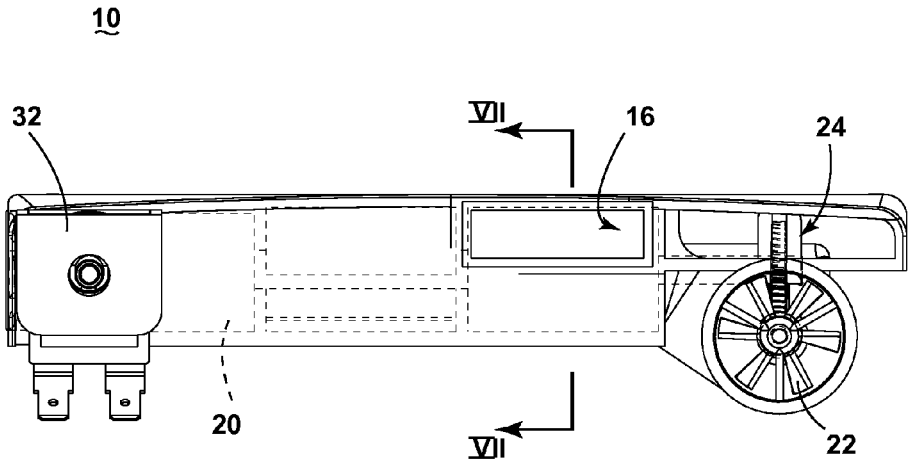
FIGS. 5 and 6 are respectively front and rear views of the example hydraulically-driven dishwasher diverter of FIGS. 1 and 2.
Figure 6:
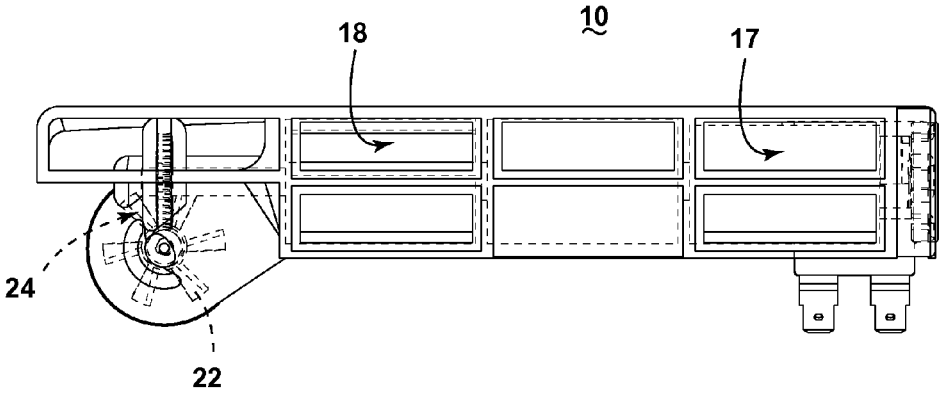
Figure 7:
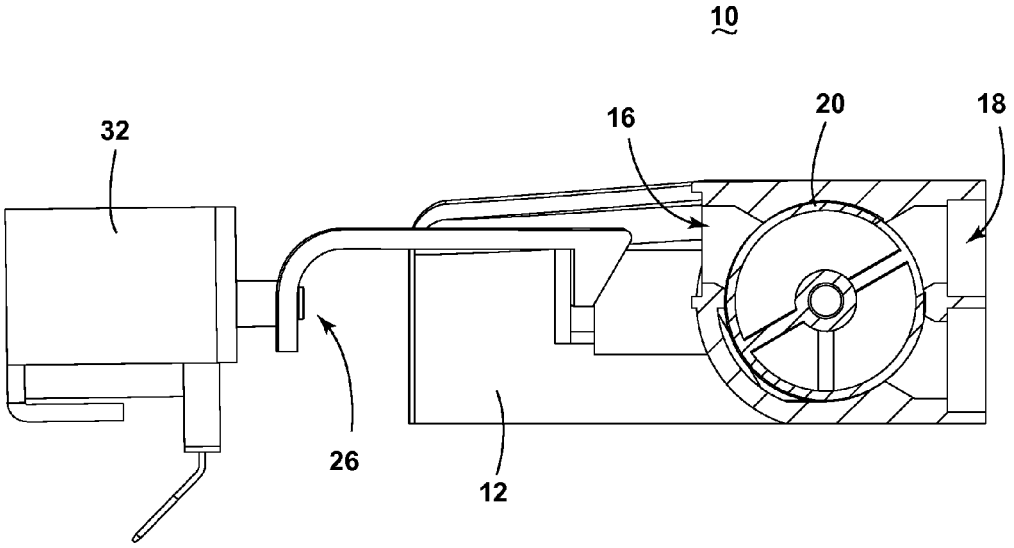
FIG. 7 is an end cross-section view of the example hydraulically-driven dishwasher diverter of FIGS. 3-6 taken along line VII-VII of FIG. 5.
Figure 8:
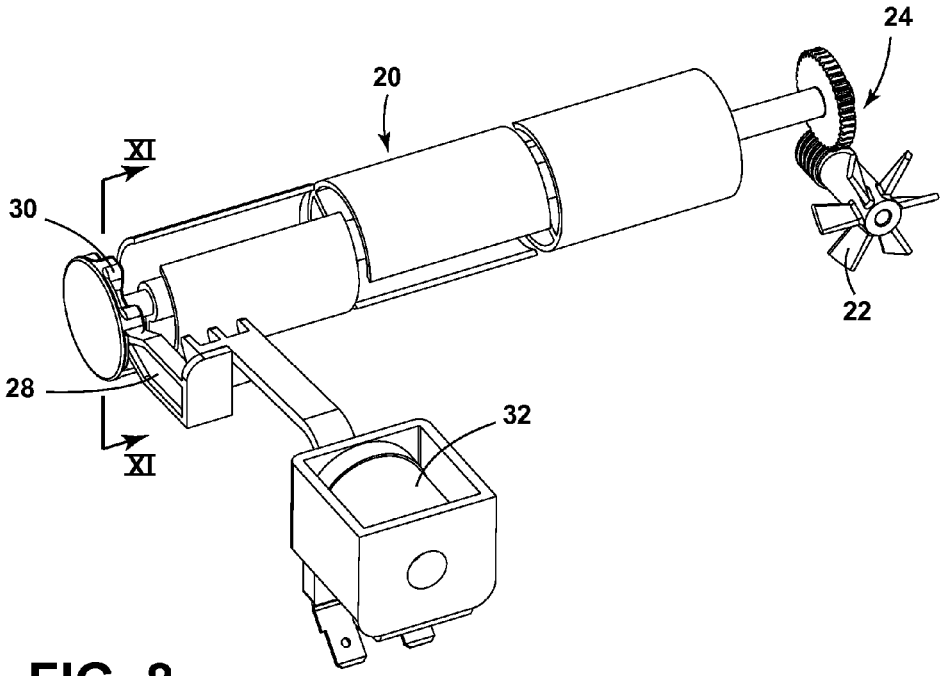
FIGS. 8 and 9 are isometric perspective views of the internal components of the example hydraulically-driven dishwasher diverter of FIGS. 3-6.
Figure 9:
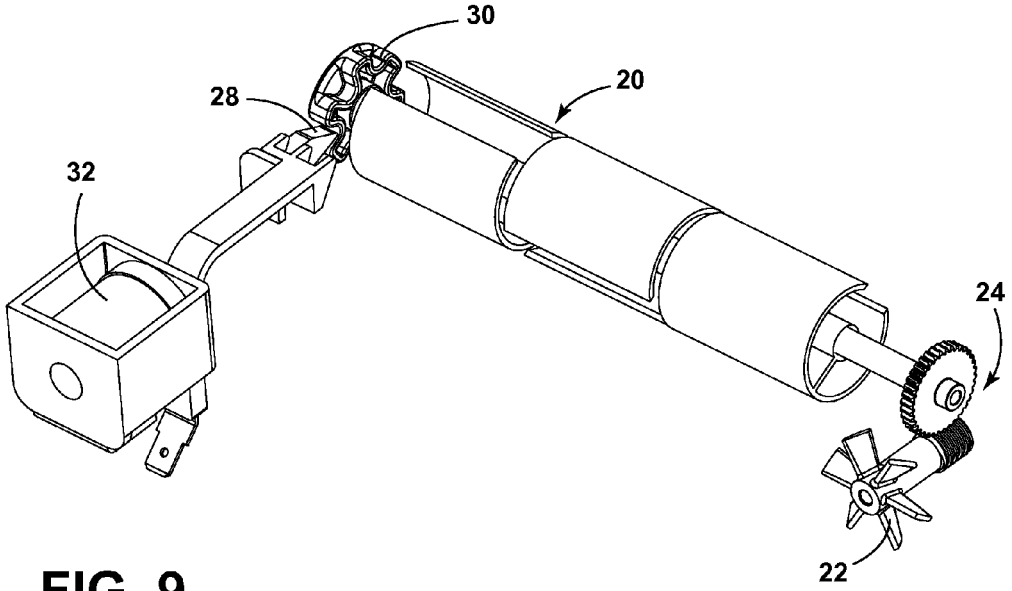
Figure 10:
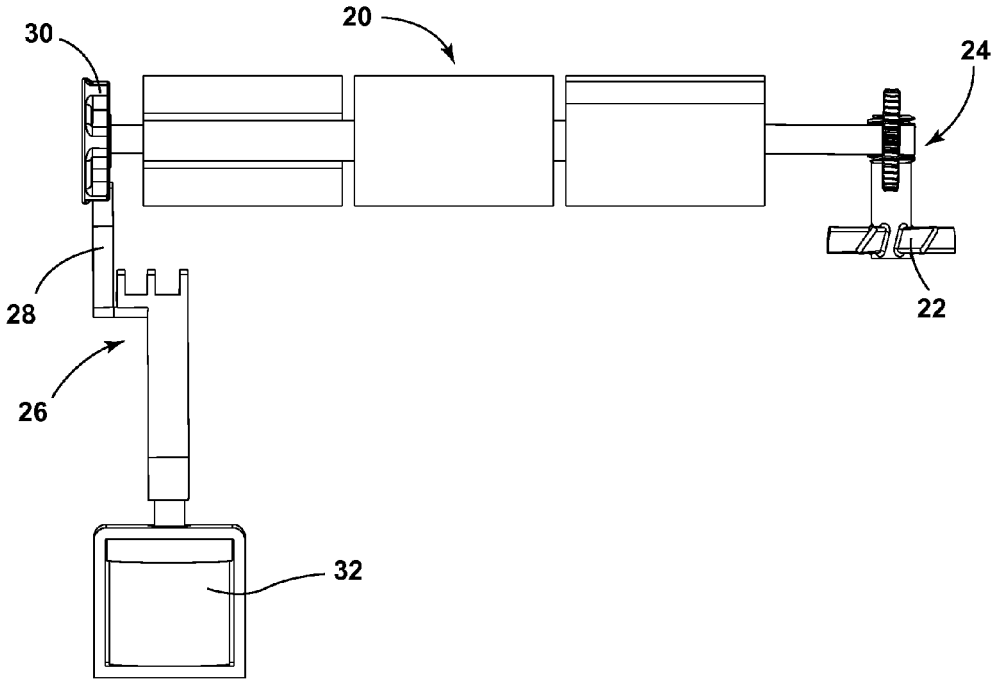
FIG. 10 is a top view of the example internal components of FIGS. 8 and 9.

Referring to FIGS. 5 and 6, for the example segment 34 the housing 12 has wash zone openings 16-18 on the back upward and downward by 45 degrees. Thus, for the two rotational positions of 15A-B, and 16-17A the valve outlet 38 does not align with any of the wash zone openings 16-18.

Referring again to FIGS. 5 and 6, for the example segment 35 the housing 12 has wash zone openings 16-18 on the back upward and downward by 45 degrees. Thus, for the rotational position of 15A and 16B, the valve outlet 39 aligns with the back upper of the wash zone opening 16-18. However, for the rotational position of 15B and 17B, the valve outlet 39 does not align with any of the wash zone openings 16-18.

Referring yet again to FIGS. 5 and 6, for the example segment 36 the housing 12 has wash zone openings 16-18 on the back upward and downward by 45 degrees. Thus, for the two rotational positions of 15A-B, and 16-17C, the valve outlet 40 does not align with any of the wash zone openings 16-18.

Due to the valve outlets 36-38, each of the example segments 34-36 have a C-shaped structure, as shown in FIGS. 15A, 15B, 16A-C and 17A-C. The cylindrical diverter valve 20 has a longitudinal core member 42, with each of the segments 34-36 connected to the core member 42 via a respective radial member 44-46. Portions of the segments 34-36 adjacent the openings 38-40 are flexible to allow them to flex in response to fluid pressure in the cylindrical diverter valve 20 to seal against wash zone openings 16-18 that do not align with a valve outlet 38-40. For example, a portion 50 of the segment 36 in the rotational position of FIG. 15A flexes and seals against the back upper wash zone opening 16-18. To allow each segment 34-36 to flex, the segments 34-36 are connected only via the longitudinal core member 42 and the radial members 44-46.

The valve outlets 38-40 are spaced apart around the cylindrical diverter valve such that fluid flows or is diverted to only one wash zone at a time. It will be understood that the locations of the valve outlets 38-40 can be selected to control a sequence of water flowing through the wash zone openings. Additionally or alternatively, the valve outlets 38-40 may be spaced apart around the cylindrical diverter valve such that fluid flows to two or more wash zones at the same time. Further still, a diverter valve can have other numbers of segments, and the housing can have other numbers of wash zone openings.

While the valve outlets 38-40 shown in the figures are rectangles or slots, other shapes such as squares, circles, ovoids, etc. may be used.

As used herein, the singular forms "a," "an" and "the" do not exclude the plural reference unless the context clearly dictates otherwise. Further, conjunctions such as "and," "or," and "and/or" used herein are inclusive unless the context clearly dictates otherwise. For example, "A and/or B" includes A alone, B alone, and A with B; "A or B" includes A with B, and "A and B" includes A alone, and B alone. Moreover, no item or component is essential to the practice of the embodiments disclosed herein unless the element is specifically described as "essential" or "critical".

Although certain examples have been described herein, the scope of coverage of this patent is not limited thereto. On the contrary, this patent covers all methods, apparatus and articles of manufacture fairly falling within the scope of the claims of this patent.

What is claimed is:

1. A dishwasher diverter comprising:

a diverter housing having a plurality of wash zone openings defined therethrough corresponding to respective wash zones of a dishwasher and having an inlet; and a rotating cylindrical diverter valve having a body with a longitudinal length, the body divided into at least two separate longitudinal segments along the length, the body including:

a first valve outlet located in one of the at least two separate longitudinal segments to fluidly couple a fluid flowing through the cylindrical diverter valve through one of the wash zone openings;

a second valve outlet located in another of the at least two separate longitudinal segments to fluidly couple a fluid flowing through the cylindrical diverter valve through another of the wash zone openings; and a flexible portion adjacent at least one of the first and second valve outlets to provide a seal in response to fluid pressure in the cylindrical diverter valve while the at least one of the first and second valve outlets is fluidly flowing the fluid through the respective wash zone opening.

2. The dishwasher diverter of claim 1, wherein the first and second valve outlets are at respective different rotational positions.

3. The dishwasher diverter of claim 2, wherein only one of the first and second valve outlets is positionable at a wash zone opening at a time.

4. The dishwasher diverter of claim 1, wherein the first valve outlet has at least one of a rectangular shape, a square shape, a circular shape, a slot, or an ovoid shape.

5. The dishwasher diverter of claim 4, wherein the first valve outlet and the adjacent flexible portion form a c-shaped structure.

6. The dishwasher diverter of claim 5, further comprising:

a longitudinal core member positioned along a rotational axis of the cylindrical diverter valve; and a radial member radially extending between the core member and an interior surface of the c-shaped structure.

7. The dishwasher diverter of claim 1, further comprising:

a conduit to fluidly flow incoming fluid into an interior of the cylindrical diverter valve; and a turbine positioned in the conduit and turning a gear responsive to the fluid flowing through the conduit, the gear rotating the cylindrical diverter valve.

8. The dishwasher diverter of claim 7, further comprising a worm gear assembly including the gear.

9. The dishwasher diverter of claim 7, wherein the fluid flows longitudinally into and through the cylindrical diverter valve to the first valve outlet, and through the first valve outlet into the one of the wash zone openings.

10. The dishwasher diverter of claim 7, wherein rotational steps of the cylindrical diverter valve position the first valve outlet at a plurality of rotational positions, including a rotational position where the first valve outlet is fluidly coupled to the one of the wash zone openings.

11. The dishwasher diverter of claim 1, wherein fluid substantially only passes through one of the wash zone openings at a time.

12. The dishwasher diverter of claim 1, further comprising a gear, a solenoid, and an indexing finger moved by the solenoid into and out of contact with the gear to control rotation of the cylindrical diverter valve in a step-wise fashion.

13. The dishwasher diverter of claim 12, wherein rotational steps of the cylindrical diverter valve position the first valve outlet at different rotational positions, including a rotational position where the first valve outlet is fluidly coupled to the one of the wash zone openings.

14. A dishwasher diverter comprising:

a diverter housing having a plurality of wash zone openings defined therethrough corresponding to respective wash zones of a dishwasher and having an inlet;

a rotating cylindrical diverter valve having a body with a longitudinal length, the body including two or more separate longitudinal segments along the longitudinal length, each separate segment having a separate valve outlet slot located entirely within the respective separate longitudinal segment and configured to fluidly couple a fluid flowing through the cylindrical diverter valve through a respective one of the wash zone openings at a respective rotational position of the cylindrical diverter valve, and a flexible portion adjacent the valve outlet slot to seal another one of the wash zone openings in response to fluid pressure in the cylindrical diverter valve while the valve outlet slot is fluidly flowing the fluid through the one of the wash zone openings, the body operably coupled to a worm gear;

a conduit configured to fluidly flow the fluid into the cylindrical diverter valve;

a turbine positioned in the conduit and configured to turn a worm drive shaft, perpendicular to and operably coupled with the worm gear and where the turbine is configured to be responsive to the fluid flowing through the conduit such that the worm drive shaft drives the cylindrical diverter valve via the worm gear; and a gear to control rotation of the cylindrical diverter valve in a step-wise fashion, wherein rotational steps of the cylindrical diverter valve position the valve outlet slots at a plurality of rotational positions, including a rotational position where a valve outlet slot is fluidly coupled to one of the wash zone openings.

15. The dishwasher diverter of claim 14, wherein only one of the valve outlet slots is positionable at one of the wash zone openings at a time.

16. The dishwasher diverter of claim 14, wherein the fluid flows longitudinally into and along the cylindrical diverter valve to the valve outlet slots, and through a valve outlet slot fluidly coupled to its respective wash zone opening.

17. The dishwasher diverter of claim 14, further comprising at least one of a solenoid, a gear, or a stepper motor controls rotation of the cylindrical diverter valve in the step-wise fashion.

18. The dishwasher diverter of claim 14, wherein a valve outlet slot and the adjacent flexible portion form a c-shaped structure.

* * * * *